US011131210B2

(12) United States Patent
Goswami et al.

(10) Patent No.: US 11,131,210 B2
(45) Date of Patent: Sep. 28, 2021

(54) COMPRESSOR FOR GAS TURBINE ENGINE WITH VARIABLE VANELESS GAP

(71) Applicant: HONEYWELL INTERNATIONAL INC., Morris Plains, NJ (US)

(72) Inventors: Shraman Narayan Goswami, Karnataka (IN); Hasham Hamzamiyan Chougule, Maharashtra (IN); Jyotichandra Shivaji Roa Jingade, Karnataka (IN); Mohd Abdullah Qizar, Karnataka (IN)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 94 days.

(21) Appl. No.: 16/246,902

(22) Filed: Jan. 14, 2019

(65) Prior Publication Data

US 2020/0224549 A1 Jul. 16, 2020

(51) Int. Cl.
*F01D 17/14* (2006.01)
*F01D 17/18* (2006.01)

(52) U.S. Cl.
CPC ..... *F01D 17/141* (2013.01); *F01D 17/18* (2013.01); *F05D 2220/32* (2013.01)

(58) Field of Classification Search
CPC .... F04D 29/444; F04D 29/464; F04D 29/544; F01D 17/18; F01D 17/141; F01D 5/225; F05D 2220/32
See application file for complete search history.

(56) References Cited

U.S. PATENT DOCUMENTS 2,967,013 A * 1/1961 Dallenbach ..... F04D 29/444 415/181
3,333,762 A 8/1967 Vrana
3,460,748 A * 8/1969 Erwin ..... F04D 29/442 415/98
3,868,196 A 2/1975 Lown
3,876,328 A 4/1975 Exley
4,349,314 A * 9/1982 Erwin ..... F04D 21/00 415/181

(Continued)

FOREIGN PATENT DOCUMENTS

EP 1199478 A1 4/2002
EP 1757814 A1 2/2007

(Continued)

*Primary Examiner* — Justin D Seabe
*Assistant Examiner* — Ryan C Clark
(74) *Attorney, Agent, or Firm* — Lorenz & Kopf, LLP

(57) ABSTRACT

A compressor of a gas turbine engine includes an impeller having a plurality of impeller blades. The compressor includes a diffuser downstream from the impeller that has a plurality of diffuser blades. Each diffuser blade extends from a hub to a shroud in a spanwise direction, and a leading edge of each diffuser blade is spaced apart from an impeller trailing edge of each of the plurality of impeller blades by a vaneless gap. Each diffuser blade includes a cutback region that extends from proximate the leading edge toward a trailing edge. The cutback region reduces a thickness of each of the diffuser blades such that a throat area defined between adjacent diffuser blades increases in the spanwise direction from the hub to the shroud and the vaneless gap increases in the spanwise direction from the hub to the shroud.

20 Claims, 12 Drawing Sheets

(56) References Cited

U.S. PATENT DOCUMENTS

| | | | | | |
|---|---|---|---|---|---|
| 4,576,550 | A | | 3/1986 | Bryans | |
| 4,790,720 | A | * | 12/1988 | Rodgers | F04D 29/444 415/208.3 |
| 4,877,370 | A | | 10/1989 | Nakagawa et al. | |
| 5,529,457 | A | | 6/1996 | Terasaki et al. | |
| 6,162,015 | A | * | 12/2000 | Nagai | F04D 17/122 415/199.2 |
| 6,203,275 | B1 | | 3/2001 | Kobayashi et al. | |
| 8,926,276 | B2 | * | 1/2015 | Japikse | F01D 9/041 415/208.3 |
| 2017/0248155 | A1 | | 8/2017 | Parker et al. | |
| 2017/0342847 | A1 | | 11/2017 | Mazur et al. | |

FOREIGN PATENT DOCUMENTS

| | | | |
|---|---|---|---|
| JP | H04334798 | A | 11/1992 |
| JP | H0526198 | A | 2/1993 |
| JP | 2007309299 | A | 11/2007 |
| JP | 2014047775 | A | 3/2014 |
| RU | 2353818 | C1 | 4/2009 |

* cited by examiner

COMPRESSOR FOR GAS TURBINE ENGINE WITH VARIABLE VANELESS GAP

TECHNICAL FIELD

The present disclosure generally relates to gas turbine engines, and more particularly relates to a compressor, such as a radial compressor, having a variable vaneless gap between a diffuser and an impeller.

BACKGROUND

Gas turbine engines may be employed to power various devices. For example, a gas turbine engine may be employed to power a mobile platform, such as an aircraft. Generally, gas turbine engines include one or more compressors, which operate to draw air into the gas turbine engine and to raise a pressure of that air. Each of the compressors has one or more airfoils or blades that are rotatable to accomplish this task. In the example of a radial compressor, the radial compressor attains a pressure rise by adding kinetic energy to the air by an impeller, and the kinetic energy is converted to a static pressure rise by a diffuser. In certain instances, spacing between the impeller and the diffuser of the radial compressor may reduce an efficiency of the radial compressor and may result in a loss in flow capacity, which may reduce performance of the gas turbine engine.

Accordingly, it is desirable to provide a variable vaneless gap between the impeller and the diffuser that increases an efficiency of the radial compressor, improves flow capacity and improves performance of the gas turbine engine. Furthermore, other desirable features and characteristics of the present invention will become apparent from the subsequent detailed description and the appended claims, taken in conjunction with the accompanying drawings and the foregoing technical field and background.

SUMMARY

In various embodiments, provided is a compressor of a gas turbine engine. The compressor includes an impeller having a plurality of impeller blades. Each impeller blade of the plurality of impeller blades has an impeller leading edge and an opposite impeller trailing edge. The compressor includes a diffuser downstream from the impeller that has a plurality of diffuser blades. Each diffuser blade has a leading edge and an opposite trailing edge. Each diffuser blade extends from a hub to a shroud in a spanwise direction, and the leading edge of each diffuser blade of the plurality of diffuser blades is spaced apart from the impeller trailing edge of each of the plurality of impeller blades by a vaneless gap. Each diffuser blade includes a cutback region that extends from proximate the leading edge toward the trailing edge. The cutback region reduces a thickness of each of the plurality of diffuser blades such that a throat area defined between adjacent diffuser blades of the plurality of diffuser blades increases in the spanwise direction from the hub to the shroud and the vaneless gap increases in the spanwise direction from the hub to the shroud.

Also provided according to various embodiments is a compressor of a gas turbine engine. The compressor includes an impeller having a plurality of impeller blades. Each impeller blade of the plurality of impeller blades has an impeller leading edge and an opposite impeller trailing edge that extends along an axis. The compressor includes a diffuser downstream from the impeller that has a plurality of diffuser blades. Each diffuser blade has a leading edge and an opposite trailing edge. Each diffuser blade extends from a hub to a shroud in a spanwise direction, and the leading edge of each diffuser blade of the plurality of diffuser blades is spaced apart from the impeller trailing edge of each of the plurality of impeller blades by a vaneless gap. The leading edge of each of the plurality of diffuser blades has a leading edge line that extends along a second axis that is transverse to the axis of the impeller trailing edge of the respective one of the plurality of impeller blades. Each diffuser blade includes a cutback region that extends from proximate the leading edge toward the trailing edge, and the cutback region reduces a thickness of each of the plurality of diffuser blades such that a throat area defined between adjacent diffuser blades of the plurality of diffuser blades varies in the spanwise direction from the hub to the shroud and the vaneless gap varies radially in the spanwise direction from the hub to the shroud.

Further provided according to various embodiments is a gas turbine engine. The gas turbine engine includes a radial compressor. The radial compressor includes an impeller having a plurality of impeller blades. Each impeller blade of the plurality of impeller blades has an impeller leading edge and an opposite impeller trailing edge that extends along an axis. The radial compressor includes a diffuser downstream from the impeller that has a plurality of diffuser blades. Each diffuser blade has a leading edge and an opposite trailing edge, and each diffuser blade extends from a hub to a shroud in a spanwise direction. The leading edge of each diffuser blade of the plurality of diffuser blades is spaced apart from the impeller trailing edge of each of the plurality of impeller blades by a vaneless gap. The leading edge of each of the plurality of diffuser blades has a leading edge line that extends along a second axis that is transverse to the axis of the impeller trailing edge of the respective one of the plurality of impeller blades, and each diffuser blade including a cutback region that extends from proximate the leading edge toward the trailing edge and from the hub to the shroud. The cutback region reduces a thickness of each of the plurality of diffuser blades in the spanwise direction such that a throat area defined between adjacent diffuser blades of the plurality of diffuser blades increases in the spanwise direction from the hub to the shroud and the vaneless gap increases radially in the spanwise direction from the hub to the shroud.

DESCRIPTION OF THE DRAWINGS

The exemplary embodiments will hereinafter be described in conjunction with the following drawing figures, wherein like numerals denote like elements, and wherein.

DETAILED DESCRIPTION

Figure 1:
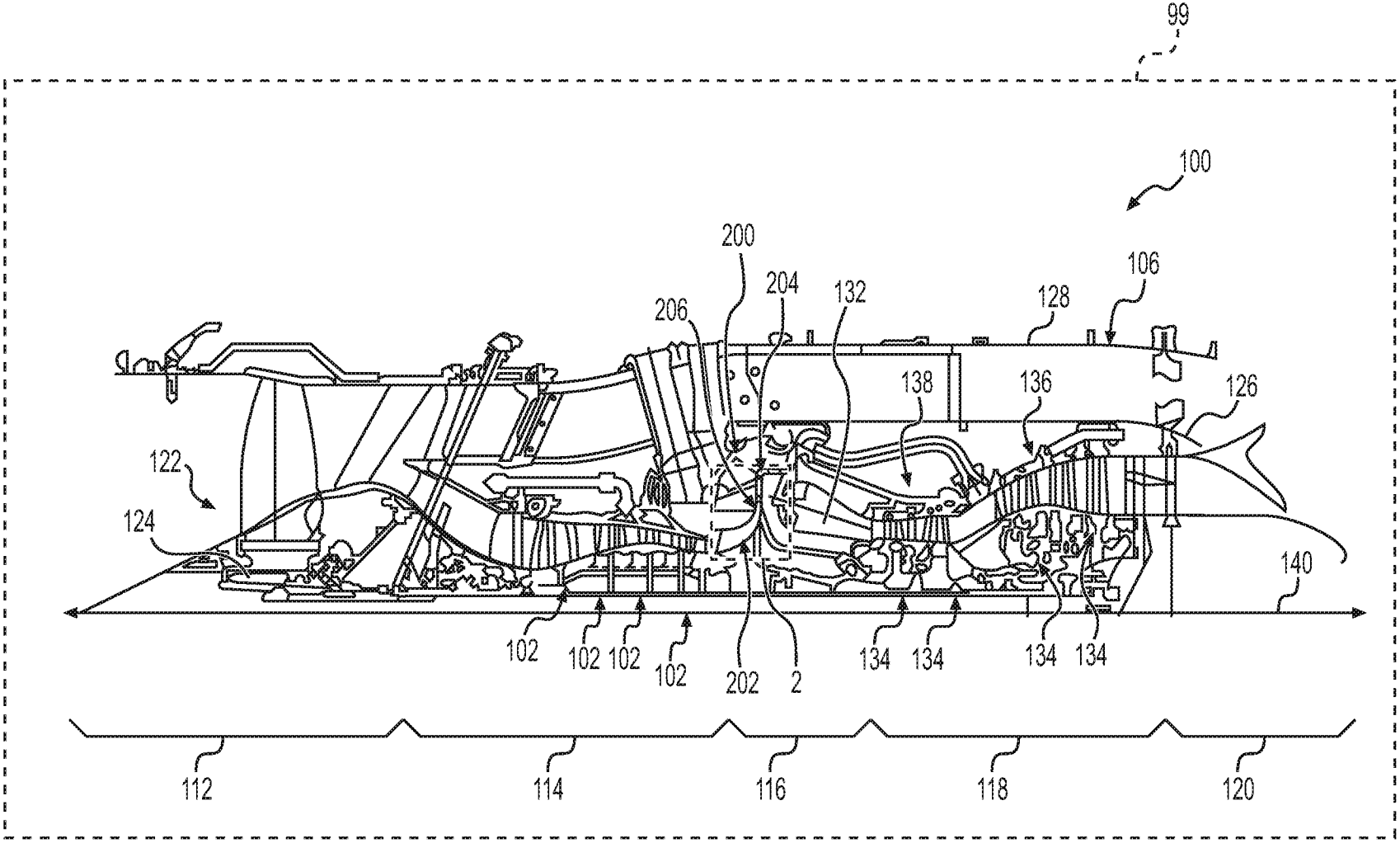
FIG. 1 is a schematic cross-sectional illustration of a gas turbine engine, which includes an exemplary radial compressor in accordance with the various teachings of the present disclosure.

The following detailed description is merely exemplary in nature and is not intended to limit the application and uses. Furthermore, there is no intention to be bound by any expressed or implied theory presented in the preceding technical field, background, brief summary or the following detailed description. In addition, those skilled in the art will appreciate that embodiments of the present disclosure may be practiced in conjunction with any type of compressor that would benefit from having a variable vaneless gap, and the radial compressor described herein for a gas turbine engine is merely one exemplary embodiment according to the present disclosure. In addition, while the radial compressor is described herein as being used with a gas turbine engine onboard a mobile platform, such as a bus, motorcycle, train, motor vehicle, marine vessel, aircraft, rotorcraft and the like, the various teachings of the present disclosure can be used with a gas turbine engine on a stationary platform. Further, it should be noted that many alternative or additional functional relationships or physical connections may be present in an embodiment of the present disclosure. In addition, while the figures shown herein depict an example with certain arrangements of elements, additional intervening elements, devices, features, or components may be present in an actual embodiment. It should also be understood that the drawings are merely illustrative and may not be drawn to scale.

As used herein, the term "axial" refers to a direction that is generally parallel to or coincident with an axis of rotation, axis of symmetry, or centerline of a component or components. For example, in a cylinder or disc with a centerline and generally circular ends or opposing faces, the "axial" direction may refer to the direction that generally extends in parallel to the centerline between the opposite ends or faces. In certain instances, the term "axial" may be utilized with respect to components that are not cylindrical (or otherwise radially symmetric). For example, the "axial" direction for a rectangular housing containing a rotating shaft may be viewed as a direction that is generally parallel to or coincident with the rotational axis of the shaft. Furthermore, the term "radially" as used herein may refer to a direction or a relationship of components with respect to a line extending outward from a shared centerline, axis, or similar reference, for example in a plane of a cylinder or disc that is perpendicular to the centerline or axis. In certain instances, components may be viewed as "radially" aligned even though one or both of the components may not be cylindrical (or otherwise radially symmetric). Furthermore, the terms "axial" and "radial" (and any derivatives) may encompass directional relationships that are other than precisely aligned with (e.g., oblique to) the true axial and radial dimensions, provided the relationship is predominately in the respective nominal axial or radial direction. As used herein, the term "transverse" denotes an axis that crosses another axis at an angle such that the axis and the other axis are neither substantially perpendicular nor substantially parallel.

With reference to FIG. 1, a partial, cross-sectional view of an exemplary gas turbine engine 100 is shown with the remaining portion of the gas turbine engine 100 being substantially axisymmetric about a longitudinal axis 140, which also comprises an axis of rotation for the gas turbine engine 100. In the depicted embodiment, the gas turbine engine 100 is an annular multi-spool turbofan gas turbine jet engine within an aircraft 99, although other arrangements and uses may be provided. For example, in other embodiments, the gas turbine engine 100 may assume the form of a non-propulsive engine, such as an Auxiliary Power Unit (APU) deployed onboard the aircraft 99, or an industrial power generator. As will be discussed herein, the gas turbine engine 100 includes a radial compressor 200, which obtains a pressure rise in a working fluid, such as air, which exits one or more axial compressors 102. As will be discussed further herein, the radial compressor 200 includes an impeller 202 and a diffuser 204. The impeller 202 is spaced apart from the diffuser 204 by a vaneless gap 206 or a gap that is devoid of vanes or airfoils. In this example, the vaneless gap 206 varies radially, which improves an efficiency of the radial compressor 200 by more than about 1.0% and increases flow capacity up to about 4%. In addition, the radial variation in the vaneless gap 206 increases pressure ratio at a choke side of the radial compressor 200 by about 16%, and improves stall margin by 14%. The radial variation in the vaneless gap 206 also reduces a weight of the radial compressor 200.

In this example, with continued reference to FIG. 1, the gas turbine engine 100 includes a fan section 112, a compressor section 114, a combustor section 116, a turbine section 118, and an exhaust section 120. In one example, the fan section 112 includes a fan 122 mounted on a rotor 124 that draws air into the gas turbine engine 100 and compresses it. A fraction of the compressed air exhausted from the fan 122 is directed through the outer bypass duct 106 and the remaining fraction of air exhausted from the fan 122 is directed into the compressor section 114. The outer bypass duct 106 is generally defined by an outer casing 128 that is spaced apart from and surrounds the exhaust guide vane 126.

In the embodiment of FIG. 1, the compressor section 114 includes the one or more axial compressors 102 and the radial compressor 200. The number of compressors in the compressor section 114 and the configuration thereof may vary. The one or more axial compressors 102 and the radial compressor 200 sequentially raise the pressure of the air and direct a majority of the high pressure air into the combustor section 116. A fraction of the compressed air bypasses the combustor section 116 and is used to cool, among other components, turbine blades in the turbine section 118.

In the embodiment of FIG. 1, in the combustor section 116, which includes a combustion chamber 132, the high pressure air is mixed with fuel, which is combusted. The high-temperature combustion air or combustive gas flow is directed into the turbine section 118. In this example, the turbine section 118 includes one or more turbines 134 disposed in axial flow series. It will be appreciated that the number of turbines, and/or the configurations thereof, may vary. The combustive gas expands through and rotates the turbines 134. The combustive gas flow then exits turbine section 118 for mixture with the cooler bypass airflow from the outer bypass duct 106 and is ultimately discharged from gas turbine engine 100 through exhaust section 120. As the turbines 134 rotate, each drives equipment in the gas turbine engine 100 via concentrically disposed shafts or spools. Generally, the turbines 134 in the turbine section 118, the axial compressors 102 and the radial compressor 200 in the compressor section 114 and the fan 122 are mechanically linked by one or more shafts or spools. For example, in a two spool turbofan engine platform, the turbine rotors contained within a high pressure (HP) turbine stage 136 may be rotationally fixed to the axial compressors 102 and the radial compressor 200 contained within compressor section 114 by a HP shaft, while the turbines 134 contained within a low pressure (LP) turbine stage 138 may be rotationally fixed to the rotor 124 of the fan 122 by a coaxial LP shaft. In other embodiments, gas turbine engine 100 may be a single spool engine or a multi-spool engine containing more than two coaxial shafts.

Figure 2:
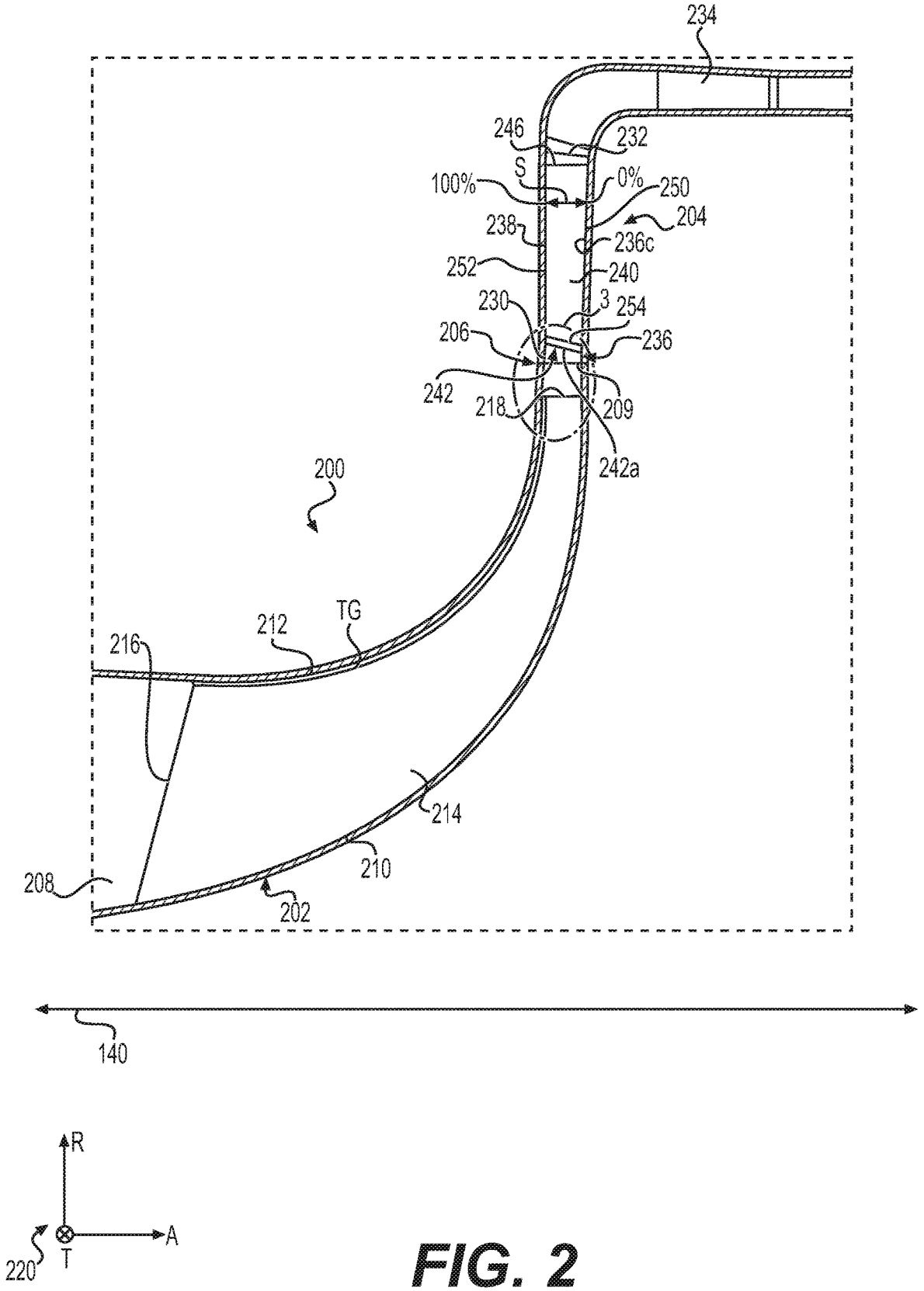
FIG. 2 is a detail cross-sectional view, taken at 2 on FIG. 1, of the radial compressor, which illustrates a variable vaneless gap between an impeller and a diffuser of the radial compressor in accordance with the various teachings of the present disclosure.

With reference to FIG. 2, a detail cross-sectional view of the radial compressor 200 is shown. In this example, the radial compressor 200 is downstream from one or more axial compressors 102 (FIG. 1) to receive the compressed air. The radial compressor 200 includes the impeller 202 upstream from the diffuser 204. The impeller 202 has an impeller inlet 208 in fluid communication with the one or more axial compressors 102 (FIG. 1) and an impeller outlet 209 in fluid communication with the diffuser 204. The impeller 202 includes an impeller hub 210, an impeller shroud 212 and at least one or a plurality of impeller blades 214. The impeller 202 may or may not contain splitter blades.

The impeller hub 210 is spaced apart from the impeller shroud 212. The impeller hub 210 is substantially annular, and is axisymmetric about the longitudinal axis 140. The impeller hub 210 is coupled to a shaft, such as the HP shaft discussed with regard to FIG. 1. The impeller hub 210 rotates with the shaft, while the impeller shroud 212 is stationary. The impeller hub 210 is composed of a metal or metal alloy, and may be formed by casting, additive manufacturing (selective metal sintering, etc.), etc. The impeller hub 210 is axially and radially spaced apart from the impeller shroud 212.

The impeller shroud 212 is positioned opposite the impeller hub 210. The impeller shroud 212 is substantially annular, and is axisymmetric about the longitudinal axis 140. The impeller shroud 212 is composed of a metal or metal alloy, and may be formed by casting, additive manufacturing (selective metal sintering, etc.), etc. The impeller shroud 212 is spaced apart from the impeller blades 214 to maintain a tip gap TG between the impeller shroud 212 and the impeller blades 214. The impeller shroud 212 may be coupled to a supporting structure associated with the gas turbine engine 100, for example, to maintain the spacing of the impeller shroud 212 from the impeller blades 214.

Figure 3:
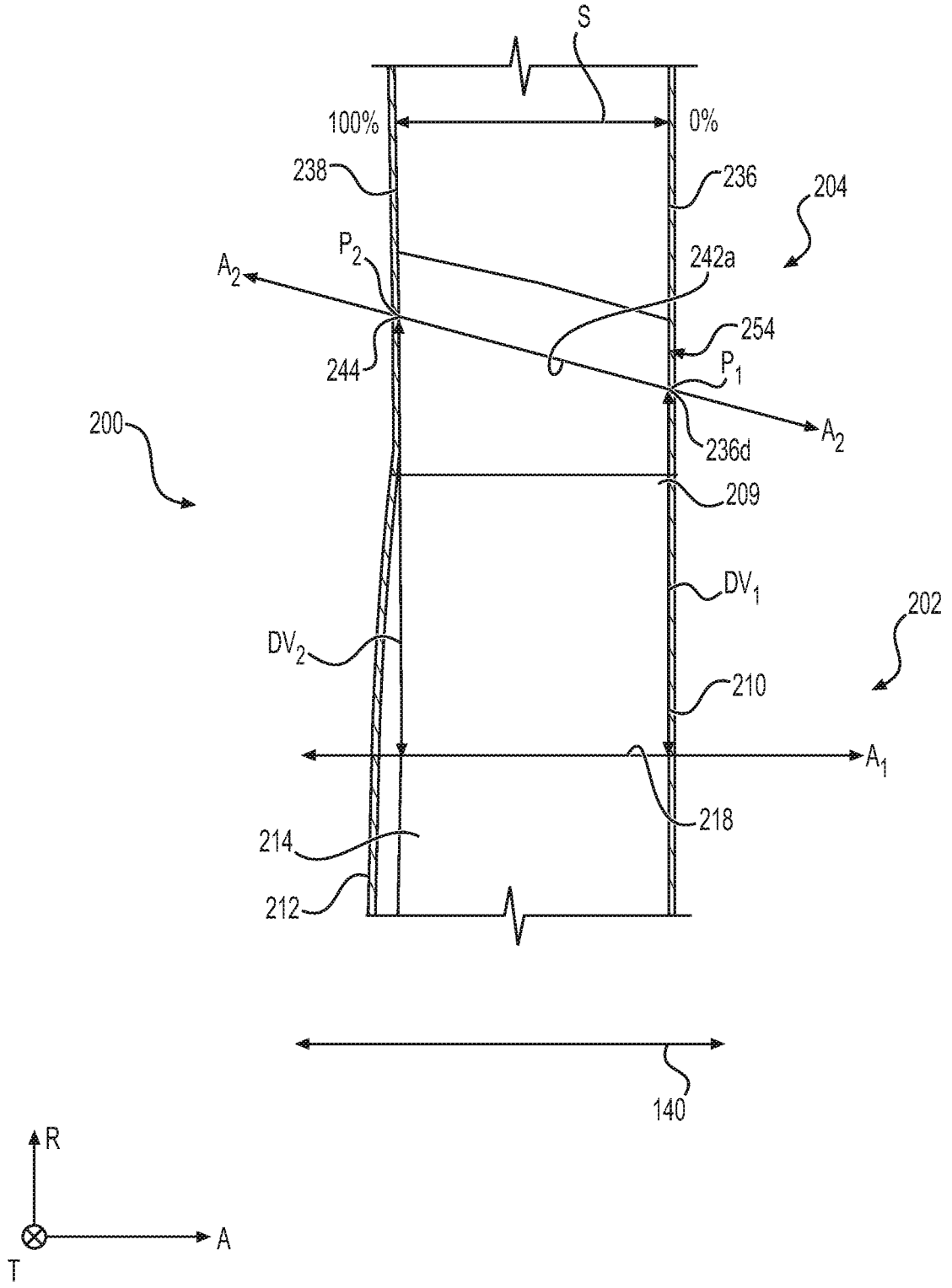
FIG. 3 is a detail cross-sectional view, taken at 3 on FIG. 2, of the variable vaneless gap between the impeller and the diffuser.

The impeller blades 214 add kinetic energy to the compressed air received through the impeller inlet 208. The impeller blades 214 are each composed of a metal or metal alloy, and may be formed by casting, additive manufacturing (selective metal sintering, etc.), etc. The impeller blades 214 are generally integrally formed with the impeller hub 210; however, the impeller blades 214 may be discretely formed and coupled to the impeller hub 210. Generally, the impeller 202 has a plurality of the impeller blades 214, which are spaced apart in an annular array about a circumference of the impeller hub 210. Each of the impeller blades 214 includes an impeller leading edge 216 and an opposite, downstream impeller trailing edge 218. The impeller leading edge 216 is in fluid communication with the impeller inlet 208, and the impeller trailing edge 218 terminates at the vaneless gap 206. With reference to FIG. 3, the impeller trailing edge 218 of each of the impeller blades 214 extends along an axis A1, which is substantially parallel to the longitudinal axis 140. Generally, the longitudinal axis 140 defines an axial direction A for the gas turbine engine 100 in a coordinate system 220, with a radial direction R defined perpendicular to the axial direction A in the coordinate system 220 (FIG. 2). A tangential direction T of the coordinate system 220 is defined into the page. Thus, the impeller trailing edge 218 is substantially planar in the axial direction A.

With reference back to FIG. 2, the diffuser 204 is downstream from the impeller 202, and is spaced apart from the impeller 202 by the vaneless gap 206. The diffuser 204 has an inlet 230 in fluid communication with the impeller outlet 209, and an outlet 232 downstream from the inlet 230. In this example, the outlet 232 is in fluid communication with a deswirl section 234, which is in fluid communication with the combustion chamber 132; however, the outlet 232 of the diffuser 204 may be in fluid communication directly with the combustion chamber 132 (FIG. 1). Generally, the deswirl section 234 contains vanes, baffles, or the like, to reduce any tangential component of the airflow remaining from the action of the impeller 202. In this example, after the pressurized air exits the outlet 232, the pressurized air flows through the deswirl section 234 and enters the combustor section 116 to be received within the combustion chamber 132 (FIG. 1). The diffuser 204 includes a hub 236, a shroud 238 and at least one or a plurality of diffuser blades 240. The diffuser 204 converts the kinetic energy imparted by the impeller 202 in the received fluid or air into a static pressure rise.

The hub 236, the shroud 238 and the diffuser blades 240 are each composed of a metal or metal alloy. The diffuser blades 240 may be integrally formed with both the hub 236 and the shroud 238 as a one-piece or monolithic structure, by casting, machining a blank, additive manufacturing, etc. Alternatively, one of the hub 236 and the shroud 238 may be integrally formed with the diffuser blades 240, via casting, machining, additive manufacturing, etc., and the other of the hub 236 and the shroud 238 may be discretely formed, via casting, machining, additive manufacturing, etc., and coupled to the diffuser blades 240 via brazing, bonding, etc. In one example, the hub 236 and the diffuser blades 240 are formed through flank milling in which the sides and the edges of the diffuser blades 240 are cut in a substantially continuous flank milling pass and the shroud 238 is formed via casting, machining, etc. and coupled to the diffuser blades 240.

Figure 4:
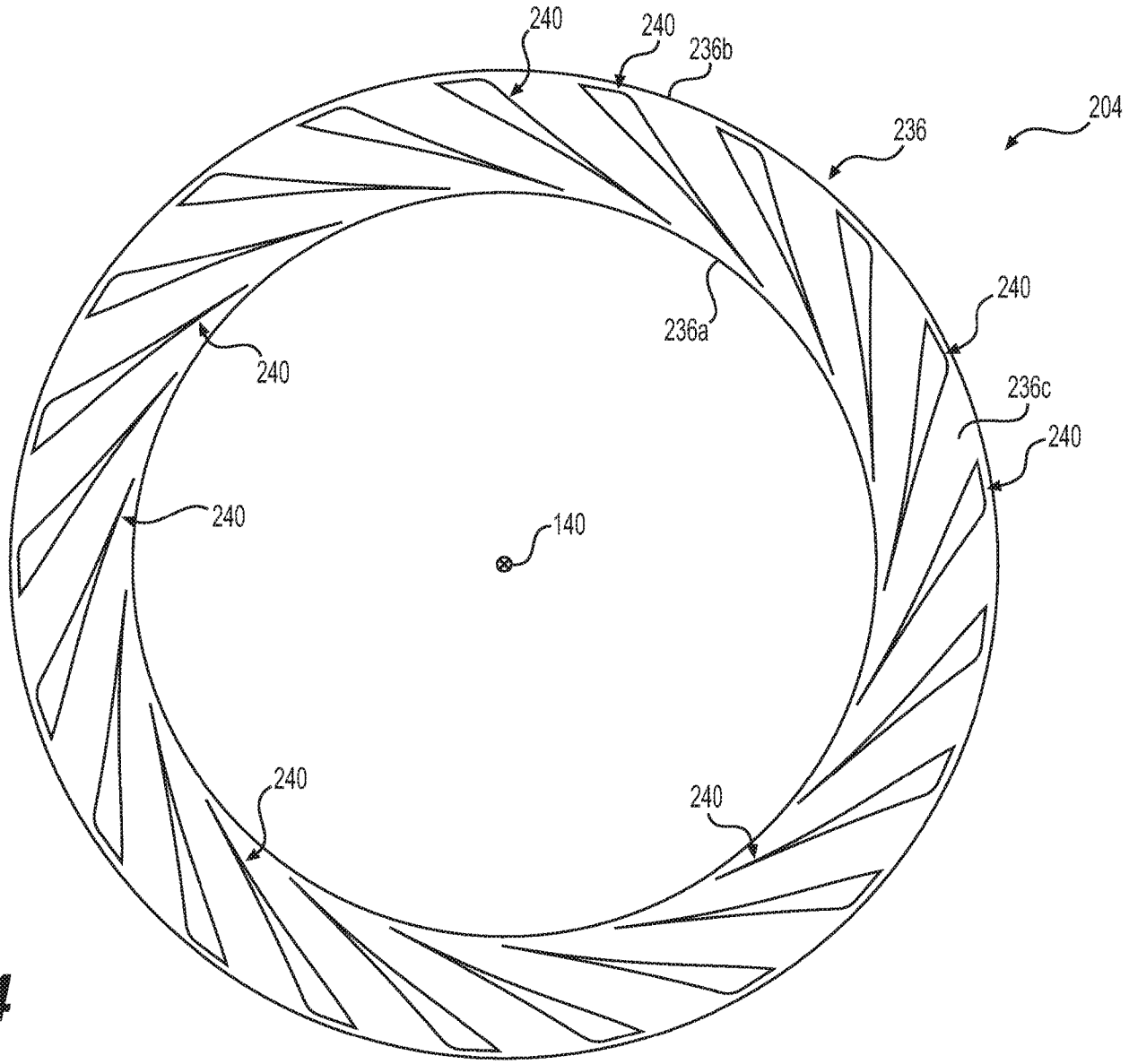
FIG. 4 is a front view of a hub and a plurality of diffuser blades for the diffuser of the radial compressor of FIG. 2, in which a shroud of the diffuser is removed for clarity.

The hub 236 is spaced apart from the shroud 238. The hub 236 circumscribes the impeller 202 when the diffuser 204 is installed in the gas turbine engine 100 (FIG. 1). With reference to FIG. 4, the hub 236 is shown in greater detail. The hub 236 is substantially annular, and is axisymmetric about the longitudinal axis 140. The hub 236 has an inner perimeter or circumference 236*a*, which is positioned proximate the impeller outlet 209 (FIG. 2). The hub 236 has an outer perimeter or circumference 236*b*, which is opposite the inner circumference 236*a*. The outer circumference 236*b* defines the outlet 232. As shown in FIG. 4, the diffuser blades 240 are coupled to the hub 236 so as to be spaced apart in an annular array about a surface 236*c* the hub 236, and are each coupled to the hub 236 so as to be positioned between the inner circumference 236*a* and the outer circumference 236*b*. In one example, each of the diffuser blades 240 is hollow or solid, and extends axially outwardly from the surface 236*c* of the hub 236.

Figure 5:
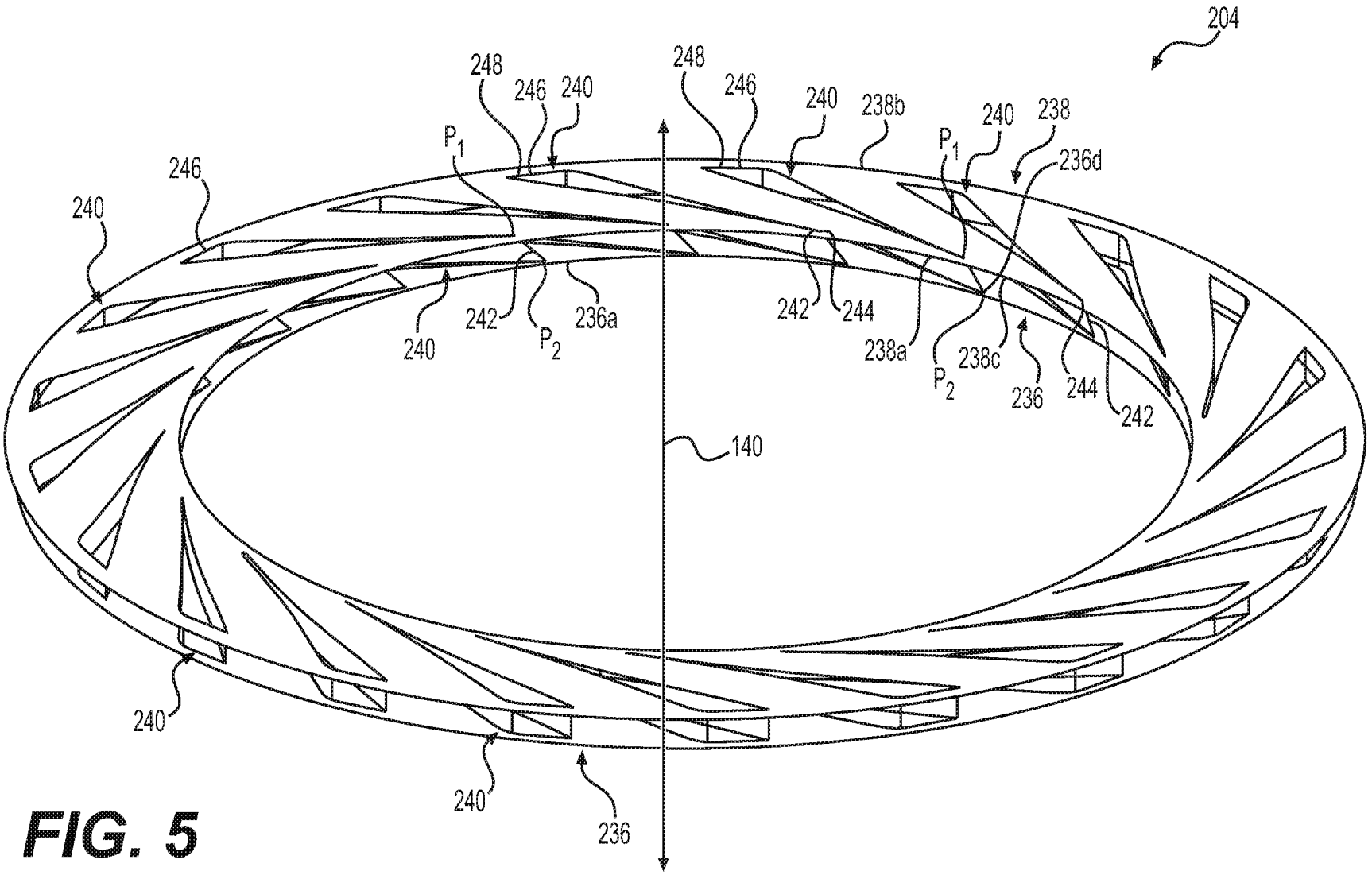
FIG. 5 is a perspective view of the diffuser of the radial compressor of FIG. 2.

With reference to FIG. 3, the shroud 238 is axially spaced apart from the hub 236, and is opposite the hub 236. The shroud 238 is coupled to each of the diffuser blades 240. With reference to FIG. 5, the shroud 238 of the diffuser 204 is shown in greater detail. FIG. 5 is a perspective view of the diffuser 204. The shroud 238 is substantially annular, and is axisymmetric about the longitudinal axis 140. The shroud 238 has an inner perimeter or circumference 238*a*, which is positioned proximate the impeller outlet 209 (FIG. 2). The shroud 238 has an outer perimeter or circumference 238*b*, which is opposite the inner circumference 238*a*. The outer circumference 238*b* cooperates with the hub 236 to define the outlet 232. The diffuser blades 240 are coupled to the shroud 238 so as to be spaced apart in an annular array about a surface 238*c* of the shroud 238, and are each coupled to the surface 238*c* of the shroud 238 so as to be positioned between the inner circumference 238*a* and the outer circumference 238*b*. For example, a leading edge 242 of each of the diffuser blades 240 is coupled to a leading end 244 of the shroud 238 proximate the inner circumference 238*a*, and a trailing edge 246 of each of the diffuser blades 240 is coupled to a trailing end 248 of the shroud 238 proximate the outer circumference 238*b*. Due to the shape of each of the diffuser blades 240, the leading end 244 of the shroud 238 is at a radial position P1, which is different than a radial position P2 of a leading end 236*d* of the hub 236 (see also FIG. 3). As will be discussed, this difference in radial positions results in a reduced thickness of each of the diffuser blades 240 such that a throat area defined between adjacent diffuser blades 240 increases in the spanwise direction from the hub 236 to the shroud 238, and the vaneless gap 206 increases in the spanwise direction from the hub 236 to the shroud 238.

With reference back to FIG. 2, the diffuser blades 240 are coupled to the hub 236 and the shroud 238. The diffuser blades 240 provide static pressure rise to the compressed air received through the inlet 230. Each of the diffuser blades 240 includes the leading edge 242 and the opposite, downstream trailing edge 246. The leading edge 242 is in fluid communication with the inlet 230, and the trailing edge 246 is proximate the outlet 232. The leading edge 242 of each of the diffuser blades 240 is spaced apart from the impeller trailing edge 218 by the vaneless gap 206. The diffuser blades 240 each extend in a spanwise direction S from the hub 236 to the shroud 238. Stated another way, each of the diffuser blades 240 has a span S, which is 0% at the hub 236 and is 100% at the shroud 238. With reference to FIG. 3, the leading edge 242 of each of the diffuser blades 240 extends along an axis A2, which is substantially transverse to the longitudinal axis 140 and is substantially transverse to the axis A1.

Figure 6:
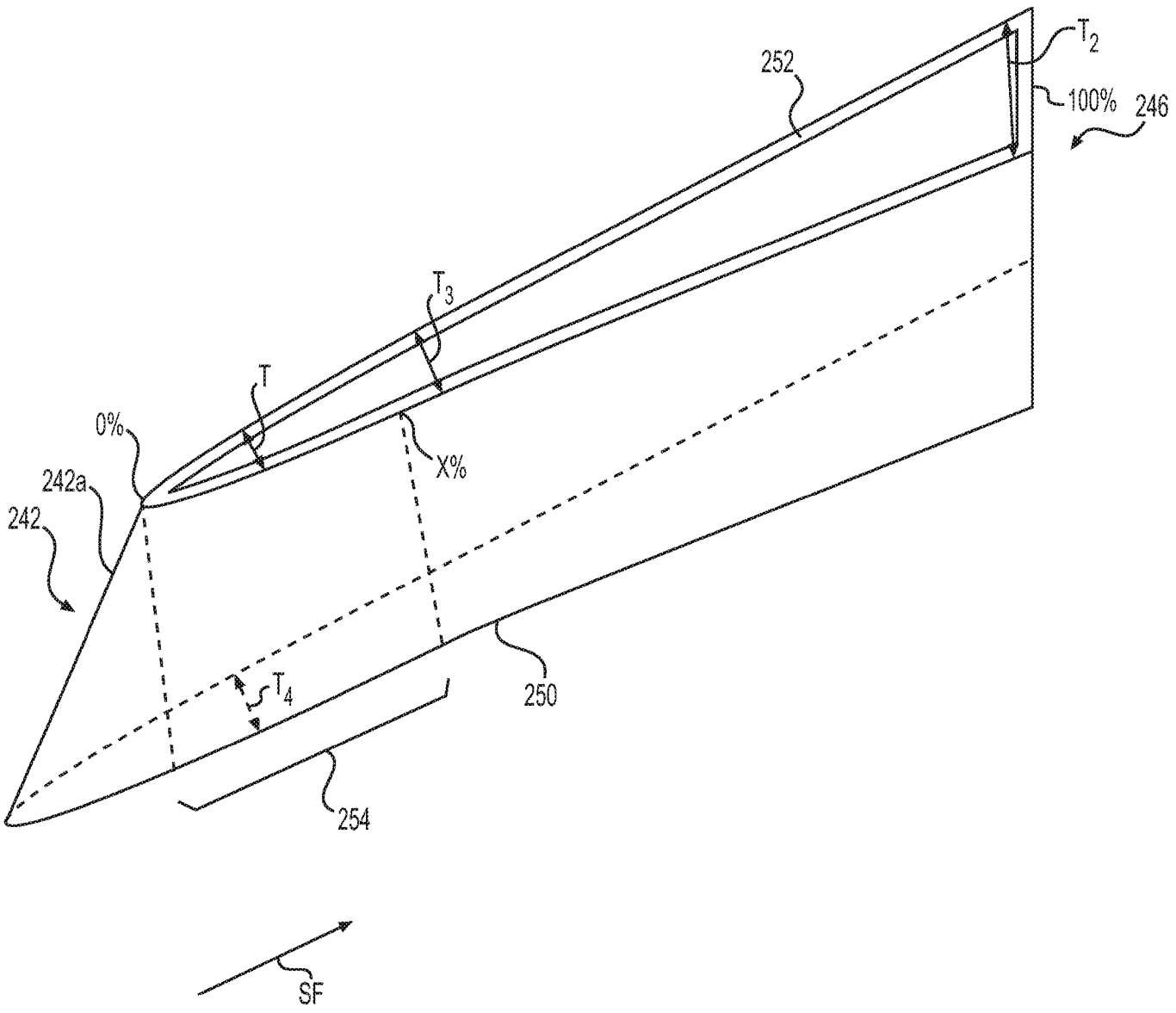
FIG. 6 is a perspective view of a diffuser blade of the diffuser of the radial compressor of FIG. 2.

With reference to FIG. 6, one of the diffuser blades 240 is shown. As each of the diffuser blades 240 is the same, only one of the diffuser blades 240 will be described in detail herein. The diffuser blade 240 has the leading edge 242, the opposed trailing edge 246, a hub surface side 250 and a shroud surface side 252 opposite the hub surface side 250. The hub surface side 250 is coupled to or integrally formed with the hub 236 (FIG. 2), and the shroud surface side 252 is coupled to or integrally formed with the shroud 238 (FIG. 2). The diffuser blade 240 is described and illustrated herein as being hollow, which provides a weight savings, however, the diffuser blade 240 may be solid from the hub surface side 250 to the shroud surface side 252.

In one example, the leading edge 242 of the diffuser blade 240 has a cutback region 254. The cutback region 254 is an area proximate the leading edge 242 that is removed or machined such that the diffuser blade 240 has a reduced thickness along the cutback region 254 and a remainder of a thickness of the diffuser blade 240 is unchanged from the cutback region 254 to the trailing edge 246. In one example, the cutback region 254 extends inwardly at an angle from the hub 236 to the shroud 238 with additional material removed evenly starting from the hub 236 towards the shroud 238 such that the thickness of the diffuser blade 240 at the shroud surface side 252 is less than the thickness of the diffuser blade 240 at the hub surface side 250 along the cutback region 254. In one example, the cutback region 254 extends from about 0% to about X % at the shroud surface side 252 in a streamwise direction SF, with 0% of the streamwise direction SF of the shroud surface side 252 at the leading edge 242 and 100% streamwise direction SF of the shroud surface side 252 at the trailing edge 246. In one example, X % is about 2% to about 10%, and in this example, X % is about 5%. Thus, in this example, from about 0% to about 5% in the streamwise direction SF at the shroud side surface 252, the thickness T of the diffuser blade 240 is different or reduced (at the shroud side surface 252) in comparison to a thickness T4 of the diffuser blade 240 at the hub surface side 250, and a remainder of the thickness of the diffuser blade 240 from X % in the streamwise direction SF at the shroud side surface 252 to the trailing edge 246 is unchanged in comparison to the thickness T4 of the diffuser blade 240 at the hub surface side 250. As the thickness T of the diffuser blade 240 is different and in this example, reduced, at the shroud side surface 252 in comparison to the thickness T4 of the diffuser blade 240 at the hub surface side 250, this results in varying throat area that gradually increases from the hub 236 to the shroud 238 between adjacent diffuser blades 240. Thus, in the cutback region 254, the diffuser blade 240 has the thickness T at the shroud side surface 252, which is different, and less than the thickness T4 of the diffuser blade 240 at the hub side surface 250. The thickness T at the shroud side surface 252 is different, and less than, a remainder of the thickness of the diffuser blade 240 from X % in the streamwise direction SF at the shroud surface side 252 to the trailing edge 246. The thickness T4 at the hub side surface 250 is unchanged or the same as the remainder of the thickness of the diffuser blade 240 from X % in the streamwise direction SF at the shroud surface side 252 to the trailing edge 246.

Figure 7:
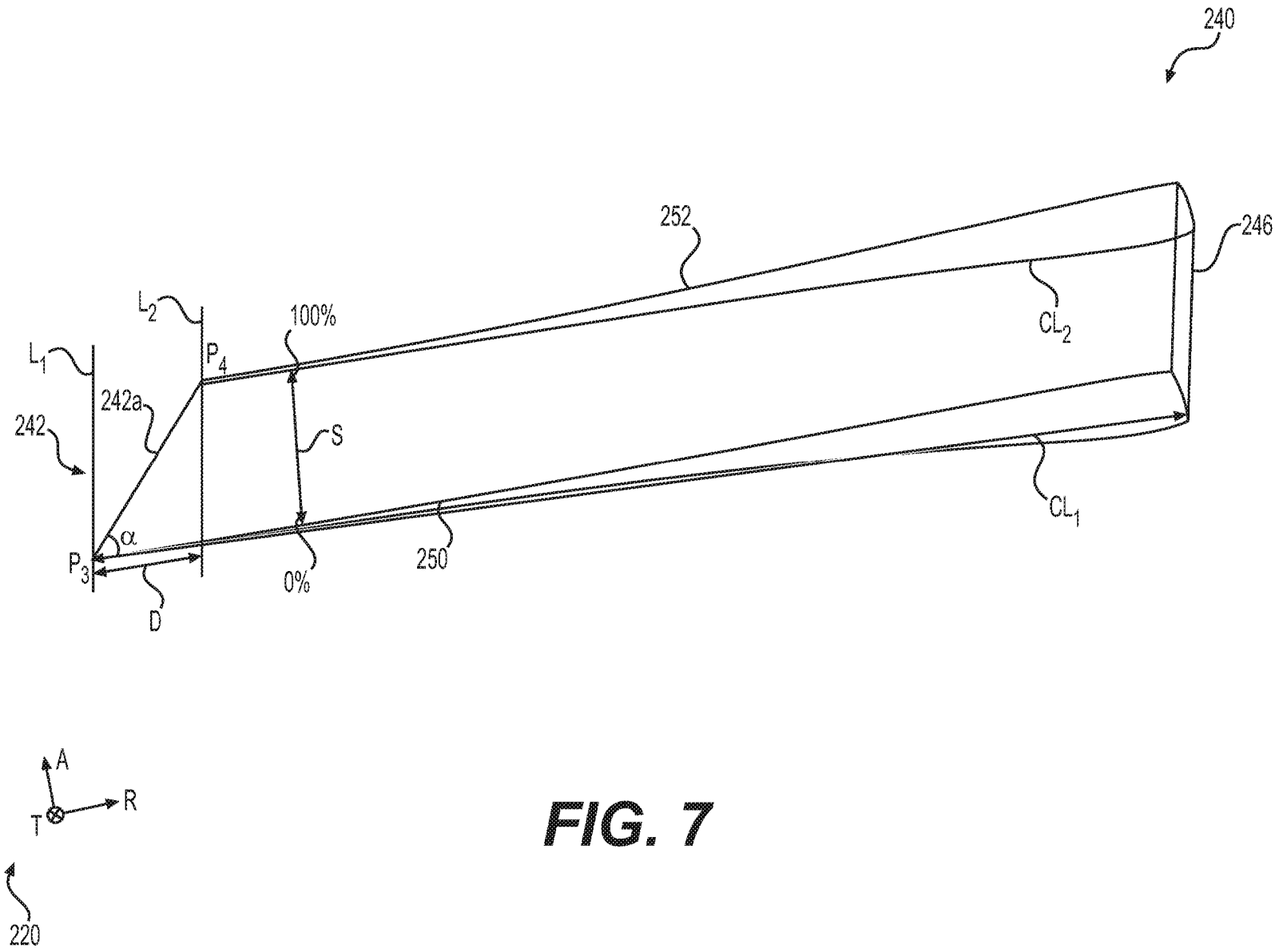
FIG. 7 is a side view of the diffuser blade of the diffuser of the radial compressor of FIG. 2.

With reference to FIG. 7, a side view of one of the diffuser blades 240 is shown. The leading edge 242 extends along a leading edge line 242*a* from the hub surface side 250 to the shroud surface side 252, and in this example, the leading edge line 242*a* is swept backward to provide a larger vaneless gap 206 at the shroud 238 than the hub 236 (FIG. 3). The leading edge 242 extends along the leading edge line 242*a* from a point P3 to a point P4. In one example, the leading edge line 242*a* is substantially linear and a straight line; however, the leading edge line 242*a* may include one or more local increases or decreases or may be curved between point P3 and P4. Thus, in this example, the leading edge line 242*a* increases or has a positive slope from the hub surface side 250 to the shroud surface side 252. Generally, point P3 is coplanar with the point P1 on the hub 236 (FIG. 3) and the point P4 is coplanar with the point P2 on the shroud 238 (FIG. 3). In one example, a line L1 containing the point P3 is offset from a line L2 containing the point P4 by a radial distance D, which is about 2% to about 30% of a length of the diffuser blade 240, and in this example, the radial distance D is about 5%. In addition, an angle α is defined between the leading edge line 242*a* and the hub surface side 250. In on example, the angle α is about 30 to about 80 degrees, and in this example, the angle α is about 45 degrees. Also, a circumferential distance between adjacent surfaces of two diffuser blades 240 is gradually increasing from the hub 236 to the shroud 238 in the spanwise direction (along the span S), such that along the cutback region 254 the circumferential distance between adjacent surfaces of two diffuser blades 240 is at a minimum at the hub surface side 250 and is at a maximum at the shroud surface side 252. In this example, a chord at the hub surface side 250 or at 0% span S has a chord length CL1, which is different, and is greater than, a chord length CL2 of a chord at the shroud surface side 252 or at 100% span S. Thus, the leading edge 242 results in different chord lengths for the diffuser blades 240 over the span S of the diffuser blades 240. Generally, the chord lengths gradually decrease over the span (or in the spanwise direction) from the hub surface side 250 to the shroud surface side 252.

Figure 8:
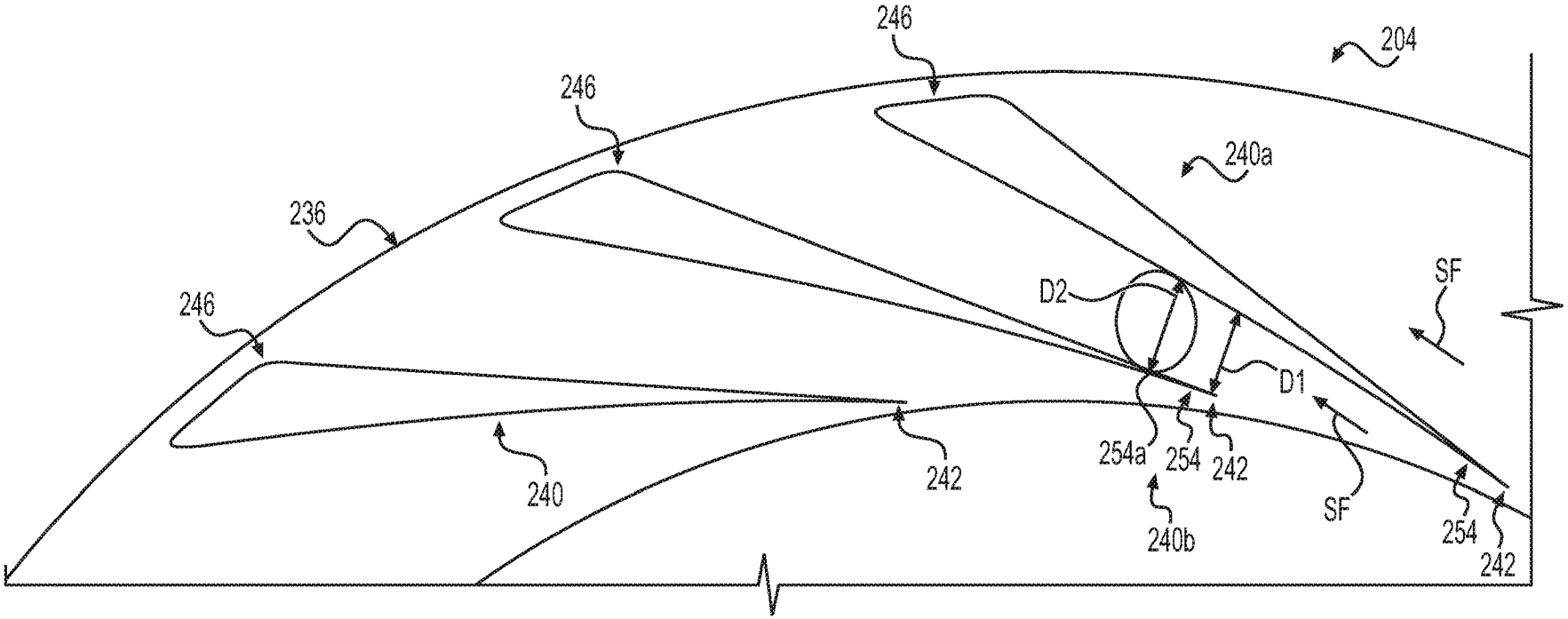
FIG. 8 is a top view of a portion of the diffuser of FIG. 2, which illustrates a throat defined between adjacent diffuser blades in which the shroud is removed for clarity.

The trailing edge 246 is downstream from the leading edge 242. In this example, with reference to FIG. 6, the diffuser blade 240 is substantially "wedge" shaped from the leading edge 242 to the trailing edge 246 such that a thickness of the diffuser blade 240 increases from the leading edge 242 to the trailing edge 246 in the streamwise SF direction. Thus, the thickness T of the cutback region 254 is different than a thickness T2 proximate the trailing edge 246, with the thickness T less than the thickness T2. Similarly, a thickness T3 adjacent to the cutback region 254 is different, and less than, the thickness T2. With reference to FIG. 8, the varying thicknesses of the diffuser blade 240 results in a throat defined between adjacent diffuser blades 240 varying between the adjacent diffuser blades 240. As used herein, the "throat" is a minimum physical distance between adjacent diffuser blades 240 in the streamwise direction SF from the leading edge 242 to the trailing edge 246. In one example, adjacent diffuser blades 240*a*, 240*b* have at least a first physical distance D1 at the leading edge 242 and a second physical distance D2 defined between adjacent surfaces of the diffuser blades 240 proximate the leading edge 242. The distance D1 is the least or minimum distance measured at the hub surface side 250 between the adjacent diffuser blades 240*a*, 240*b* and the distance D2 is the least or minimum distance measured at the shroud surface side 252 between the adjacent diffuser blades 240*a*, 240*b*. Within the cutback region 254, the distance D2 is greater than the distance D1, which forms the gradual increase in the throat from the hub 236 to the shroud 238 in the spanwise direction.

Figure 9:
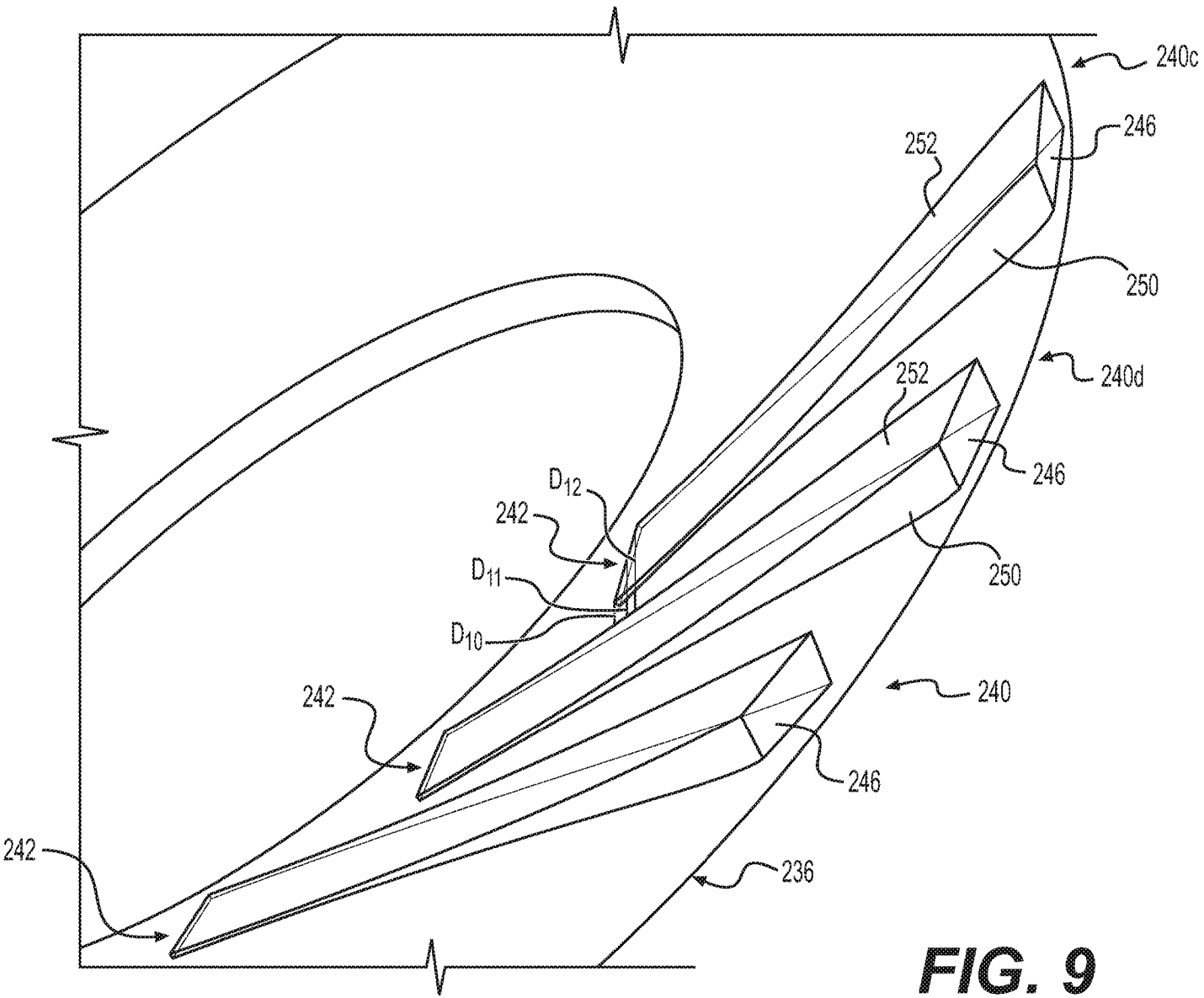
FIG. 9 is a perspective view the portion of the diffuser of FIG. 2, which illustrates a throat area defined between adjacent diffuser blades in which the shroud is removed for clarity.

The cutback region 254 also results in a throat area between adjacent diffuser blades 240 varying in the spanwise direction. As used herein, the "throat area" is a product of a least or minimum physical distance between adjacent diffuser blades 240 over the span S (i.e. from the hub 236 to the shroud 238) of the adjacent diffuser blades 240. In one example, adjacent diffuser blades 240*c*, 240*d* (FIG. 9) have at least a first physical distance D10, a second physical distance D11 and a third physical distance D12 defined between adjacent surfaces from the hub surface side 250 to the shroud surface side 252. The distance D10 is less than the distance D11, and the distance D11 is less than the distance D12. The increase in the distances D10-D12 results in an increase in the throat area from the hub 236 (hub surface side 250) to the shroud 238 (shroud surface side 252). Thus, a cross-sectional area of the diffuser 204 also increases, in this example, linearly, from the hub 236 to the shroud 238.

With reference to FIG. 3, the vaneless gap 206 is defined between the impeller 202 and the diffuser 204. The vaneless gap 206 varies from the hub 236 to the shroud 238. Generally, for each diffuser blade 240, the vaneless gap 206 is defined as a distance between the impeller trailing edge 218 of a respective impeller blade 214 and the leading edge line 242*a* of the leading edge 242 of the respective diffuser blade 240, which is devoid of vanes or airfoils. Thus, in this example, due to the shape of the leading edge line 242*a*, the vaneless gap 206 varies monotonically from the hub 236 to the shroud 238 or increases from the hub 236 to the shroud 238. In this example, the vaneless gap 206 has a first, radial distance DV1 defined from the point P1 at the hub 236 to the impeller trailing edge 218 and a second, radial distance DV2 defined from the point P2 at the shroud 238 to the impeller trailing edge 218. The first, radial distance DV1 is different, and less than, the second, radial distance DV2 and the vaneless gap 206 increases from the hub 236 to the shroud 238. In one example, the second, radial distance DV2 is about 1% to about 20% greater than the first, radial distance DV1, and in this example, the second, radial distance DV2 is about 1.2% greater than the first distance DV1. In this example, for each point on the leading edge line 242*a*, a radial distance defined between the point on the leading edge line 242*a* and the impeller trailing edge 218 is different, with the radial distance increasing from the hub 236 to the shroud 238.

In one example, with reference to FIG. 2, with the impeller blades 214 formed in the annular array with the impeller hub 210, the impeller hub 210 is coupled to the shaft, such as the HP shaft discussed with regard to FIG. 1. The impeller shroud 212 is coupled to the gas turbine engine 100 so as to be opposite the impeller hub 210. The diffuser 204 is formed such that the diffuser blades 240 are coupled between the hub 236 and the shroud 238. Each of the diffuser blades 240 is formed with the cutback region 254 formed from the leading edge 242 towards the trailing edge 246 in the streamwise direction SF (FIG. 6) or the radial direction R. The diffuser 204 is coupled to the gas turbine engine 100 such that the impeller 202 is circumscribed by the diffuser 204 and the vaneless gap 206 is defined between the leading edge line 242*a* and the impeller trailing edge 218. The vaneless gap 206 varies, and in this example, increases from the hub 236 to the shroud 238.

During operation of the gas turbine engine 100, the compressed air from the one or more axial compressors 102 (FIG. 1) flows into the impeller inlet 208. The impeller blades 214 of the impeller 202, which may be driven by the HP turbine stage 136 (FIG. 1), imparts kinetic energy into the compressed air. The air exits the impeller outlet 209 and flows into the diffuser 204. The diffuser blades 240 convert the kinetic energy imparted by the impeller 202 into a static pressure rise. The variation in the vaneless gap 206 from the hub 236 to the shroud 238 provides room for a tip vortex of the compressed air to diffuse, and improves efficiency of the radial compressor 200. Further, the variation in the vaneless gap 206 reduces flow losses. The gradual increase in the throat area from the hub 236 to the shroud 238 in the spanwise direction improves choke flow capacity of the radial compressor 200 by about 2% to about 4%.

Figure 10:
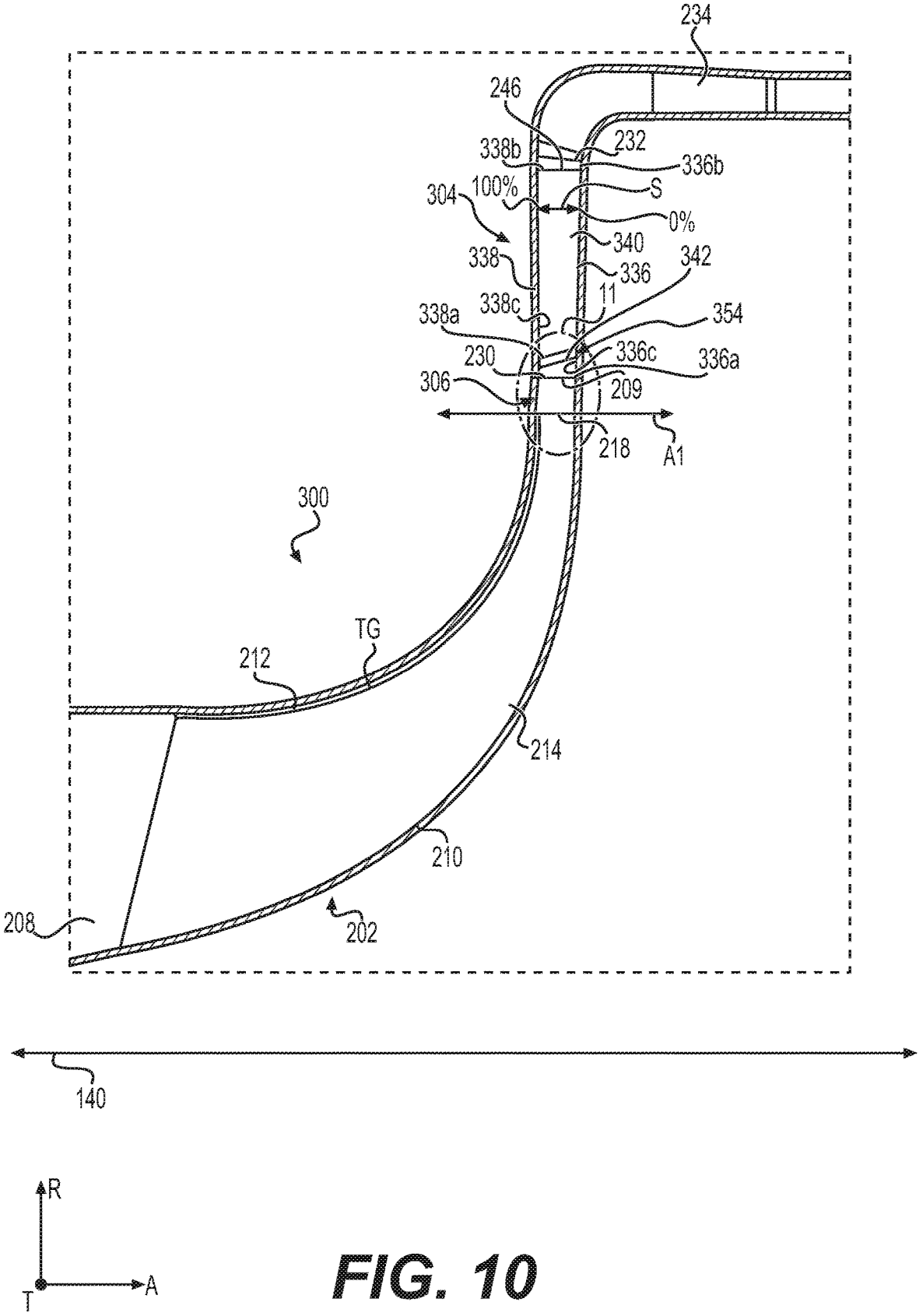
FIG. 10 is a detail cross-sectional view, taken from the perspective of 2 on FIG. 1, of another exemplary radial compressor for use with the gas turbine engine of FIG. 1, which illustrates another exemplary variable vaneless gap between the impeller and a diffuser of the radial compressor in accordance with the various teachings of the present disclosure.

It should be noted that in other embodiments, the leading edge line 242*a* of each of the diffuser blades 240 may be configured differently to improve efficiency of the radial compressor 200. For example, with reference to FIG. 10, a radial compressor 300 is shown. As the radial compressor 300 includes components that are the same or similar to components of the radial compressor 200 discussed with regard to FIGS. 1-9, the same reference numerals will be used to denote the same or similar components. The radial compressor 300 includes the impeller 202 upstream from a diffuser 304. The impeller 202 has the impeller inlet 208 in fluid communication with the one or more axial compressors 102 (FIG. 1) and the impeller outlet 209 in fluid communication with the diffuser 304. The impeller 202 includes the impeller hub 210, the impeller shroud 212 and the plurality of impeller blades 214. The impeller trailing edge 218 of each of the impeller blades 214 extends along the axis A1, which is substantially parallel to the longitudinal axis 140.

The diffuser 304 is downstream from the impeller 202, and is spaced apart from the impeller 202 by a vaneless gap 306. The diffuser 304 has the inlet 230 in fluid communication with the impeller outlet 209, and the outlet 232 downstream from the inlet 230. In this example, the outlet 232 is in fluid communication with the deswirl section 234, however, the outlet 232 of the diffuser 204 may be in fluid communication directly with the combustion chamber 132 (FIG. 1). The diffuser 304 includes a hub 336, a shroud 338 and at least one or a plurality of diffuser blades 340. The diffuser 304 converts the kinetic energy imparted by the impeller 202 in the received fluid or air into a static pressure rise.

The hub 336, the shroud 338 and the diffuser blades 340 are each composed of a metal or metal alloy. The diffuser blades 340 may be integrally formed with both the hub 336 and the shroud 238 as a one-piece or monolithic structure, by casting, machining a blank, additive manufacturing, etc. Alternatively, one of the hub 336 and the shroud 338 may be integrally formed with the diffuser blades 340, via casting, machining, additive manufacturing, etc., and the other of the hub 336 and the shroud 338 may be discretely formed, via casting, machining, additive manufacturing, etc., and coupled to the diffuser blades 340 via brazing, bonding, etc.

The hub 336 is spaced apart from the shroud 338. The hub 336 circumscribes the impeller 202 when the diffuser 304 is installed in the gas turbine engine 100 (FIG. 1). The hub 336 is substantially annular, and is axisymmetric about the longitudinal axis 140. The hub 336 has an inner perimeter or circumference 336*a*, which is positioned proximate the impeller outlet 209. The hub 336 has an outer perimeter or circumference 336*b*, which is opposite the inner circumference 336*a*. The outer circumference 336*b* defines the outlet 232. The diffuser blades 340 are coupled to the hub 336 so as to be spaced apart in an annular array about a surface 336*c* the hub 336, and are each coupled to the hub 336 so as to be positioned between an inner circumference 336*a* and an outer circumference 336*b*. In one example, each of the diffuser blades 340 is hollow or solid, and extends axially outwardly from the surface 336*c* of the hub 336.

The shroud 338 is axially spaced apart from the hub 336, and is opposite the hub 336. The shroud 338 is coupled to each of the diffuser blades 340. The shroud 338 is substantially annular, and is axisymmetric about the longitudinal axis 140. The shroud 338 has an inner perimeter or circumference 338*a*, which is positioned proximate the impeller outlet 209. The shroud 338 has an outer perimeter or circumference 338*b*, which is opposite the inner circumference 338*a*. The outer circumference 338*b* cooperates with the hub 336 to define the outlet 232. The diffuser blades 340 are coupled to the shroud 338 so as to be spaced apart in an annular array about a surface 338*c* of the shroud 338, and are each coupled to the surface 338*c* of the shroud 338 so as to be positioned between the inner circumference 338*a* and the outer circumference 338*b*.

Figure 11:
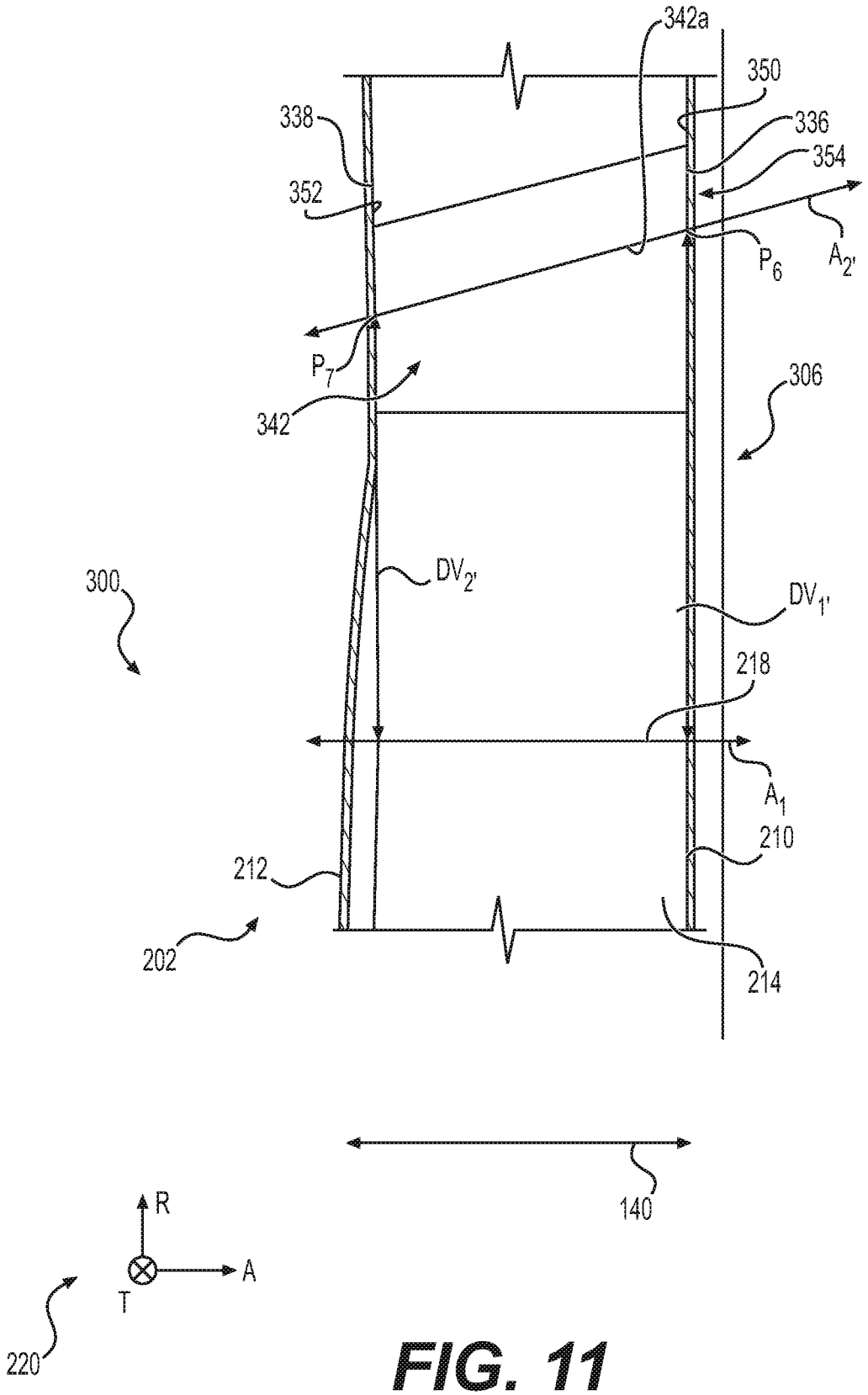
FIG. 11 is a detail cross-sectional view, taken at 11 on FIG. 10, of the variable vaneless gap between the impeller and the diffuser of the radial compressor of FIG. 10.

The diffuser blades 340 are coupled to the hub 336 and the shroud 338. The diffuser blades 340 provide static pressure rise to the compressed air received through the inlet 230. Each of the diffuser blades 340 includes a leading edge 342 and the opposite, downstream trailing edge 246. The leading edge 342 is in fluid communication with the inlet 230, and the trailing edge 246 is proximate the outlet 232. The leading edge 342 of each of the diffuser blades 340 is spaced apart from the impeller trailing edge 218 by the vaneless gap 306. The diffuser blades 340 each extend in a spanwise direction S from the hub 336 to the shroud 338. Stated another way, each of the diffuser blades 340 has a span S, which is 0% at the hub 336 and is 100% at the shroud 338. With reference to FIG. 11, the leading edge 342 of each of the diffuser blades 340 extends along an axis A2', which is substantially transverse to the longitudinal axis 140 and is substantially transverse to the axis A1.

The diffuser blade 340 has the leading edge 342, the opposed trailing edge 246, a hub surface side 350 and a shroud surface side 352 opposite the hub surface side 350. The diffuser blade 340 is described and illustrated herein as being hollow, which provides a weight savings, however, the diffuser blade 340 may be solid from the hub surface side 350 to the shroud surface side 352. In one example, the leading edge 342 of the diffuser blade 240 has a cutback region 354. In one example, the cutback region 354 extends inwardly at an angle from the shroud 338 to the hub 336 with additional material removed evenly starting from the shroud 338 towards the hub 336 such that the thickness of the diffuser blade 340 at the shroud surface side 352 is greater than the thickness of the diffuser blade 340 at the hub surface side 350 along the cutback region 354. In one example, the cutback region 354 extends from about 0% to about X % at the hub surface side 350 in the streamwise direction SF, and in one example, X % is about 2% to about 10%, and in this example, X % is about 5%. Thus, in this example, from about 0% to about 5% in the streamwise direction SF at the hub side surface 350, the thickness of the diffuser blade 340 is different or reduced (at the hub side surface 350) in comparison to a thickness of the diffuser blade 340 at the shroud surface side 352, and a remainder of the thickness of the diffuser blade 340 from X % in the streamwise direction SF at the hub side surface 350 to the trailing edge 246 is unchanged in comparison to the thickness of the diffuser blade 340 at the shroud surface side 352. As the thickness of the diffuser blade 340 is different and in this example, reduced, at the hub side surface 350 in comparison to the thickness of the diffuser blade 340 at the shroud surface side 352, this results in varying throat area that gradually decreases from the hub 336 to the shroud 338 between adjacent diffuser blades 340. Thus, in the cutback region 354, the diffuser blade 340 has the thickness at the shroud side surface 352, which is different, and greater than the thickness of the diffuser blade 340 at the hub side surface 350. The thickness at the shroud side surface 352 is different, and greater than, a remainder of the thickness of the diffuser blade 340 from X % in the streamwise direction SF at the hub side surface 350 to the trailing edge 246. The thickness at the shroud side surface 352 is unchanged or the same as the remainder of the thickness of the diffuser blade 340 from X % in the streamwise direction SF at the hub side surface 350 to the trailing edge 246. The cutback region 354 also results in a throat area between adjacent diffuser blades 340 varying in the spanwise direction. In one example, the throat area decreases from the hub 336 (hub surface side 350) to the shroud 338 (shroud surface side 352). Thus, a cross-sectional area of the diffuser 304 also decreases, in this example, linearly, from the hub 336 to the shroud 338.

The leading edge 342 extends along a leading edge line 342*a* from the hub surface side 350 to the shroud surface side 352, and in this example, the leading edge line 342*a* is swept forward to provide a larger vaneless gap 306 at the hub 336 than the shroud 338. The leading edge 342 extends along the leading edge line 342*a* from a point P6 to a point P7. In one example, the leading edge line 342*a* is substantially linear and a straight line; however, the leading edge line 342*a* may include one or more local increases or decreases or may be curved between point P6 and P7. Thus, in this example, the leading edge line 342*a* decreases or has a negative slope from the hub 336 to the shroud 338. In this example, for each diffuser blade 340, a chord at the hub surface side 350 or at 0% span S has a chord length, which is different, and is less than, a chord length of a chord at the shroud surface side 352 or at 100% span S. Thus, the leading edge 342 results in different chord lengths for the diffuser blades 340 over the span S of the diffuser blades 340. Generally, the chord lengths increase over the span (or in the spanwise direction) from the hub 336 to the shroud 338.

The vaneless gap 306 is defined between the impeller 202 and the diffuser 304. The vaneless gap 306 varies from the hub 336 to the shroud 338. Generally, for each diffuser blade 340, the vaneless gap 306 is defined as a distance between the impeller trailing edge 218 of a respective impeller blade 214 and the leading edge line 342*a* of the leading edge 342 of the respective diffuser blade 340, which is devoid of vanes or airfoils. Thus, in this example, due to the shape of the leading edge line 342*a*, the vaneless gap 306 varies monotonically from the hub 336 to the shroud 338 or decreases from the hub 336 to the shroud 338. In this example, the vaneless gap 306 has a first, radial distance DV1' defined from the point P6 at the hub 336 to the impeller trailing edge 218 and a second, radial distance DV2' defined from the point P7 at the shroud 338 to the impeller trailing edge 218. The first, radial distance DV1' is different, and greater than, the second, radial distance DV2' and the vaneless gap 306 decreases from the hub 336 to the shroud 338. In one example, the second, radial distance DV2' is about 1% to about 20% less than the first, radial distance DV1', and in this example, the second, radial distance DV2' is about 1.2% less than the first distance DV1'. In this example, for each point on the leading edge line 342*a*, a radial distance defined between the point on the leading edge line 342*a* and the impeller trailing edge 218 is different, with the radial distance decreasing from the hub 336 to the shroud 338.

As the assembly and the use of the radial compressor 300 including the diffuser 304 is substantially the same as that discussed with regard to the radial compressor 200 and the diffuser 204 of FIGS. 1-9, the assembly and use of the radial compressor 300 and the diffuser 304 will not be discussed in great detail herein. Briefly, the diffuser 304 is formed such that the diffuser blades 340 are coupled between the hub 336 and the shroud 338. Each of the diffuser blades 340 is formed with the cutback region 354 formed from the leading edge 342 towards the trailing edge 246 in the radial direction R. The diffuser 304 is coupled to the gas turbine engine 100 such that the impeller 202 is circumscribed by the diffuser 304 and the vaneless gap 306 is defined between the leading edge line 342*a* and the impeller trailing edge 218. The vaneless gap 306 varies, and in this example, decreases from the hub 336 to the shroud 338. The vaneless gap 306 provides for an increase in efficiency gain for the radial compressor 300.

Figure 12:
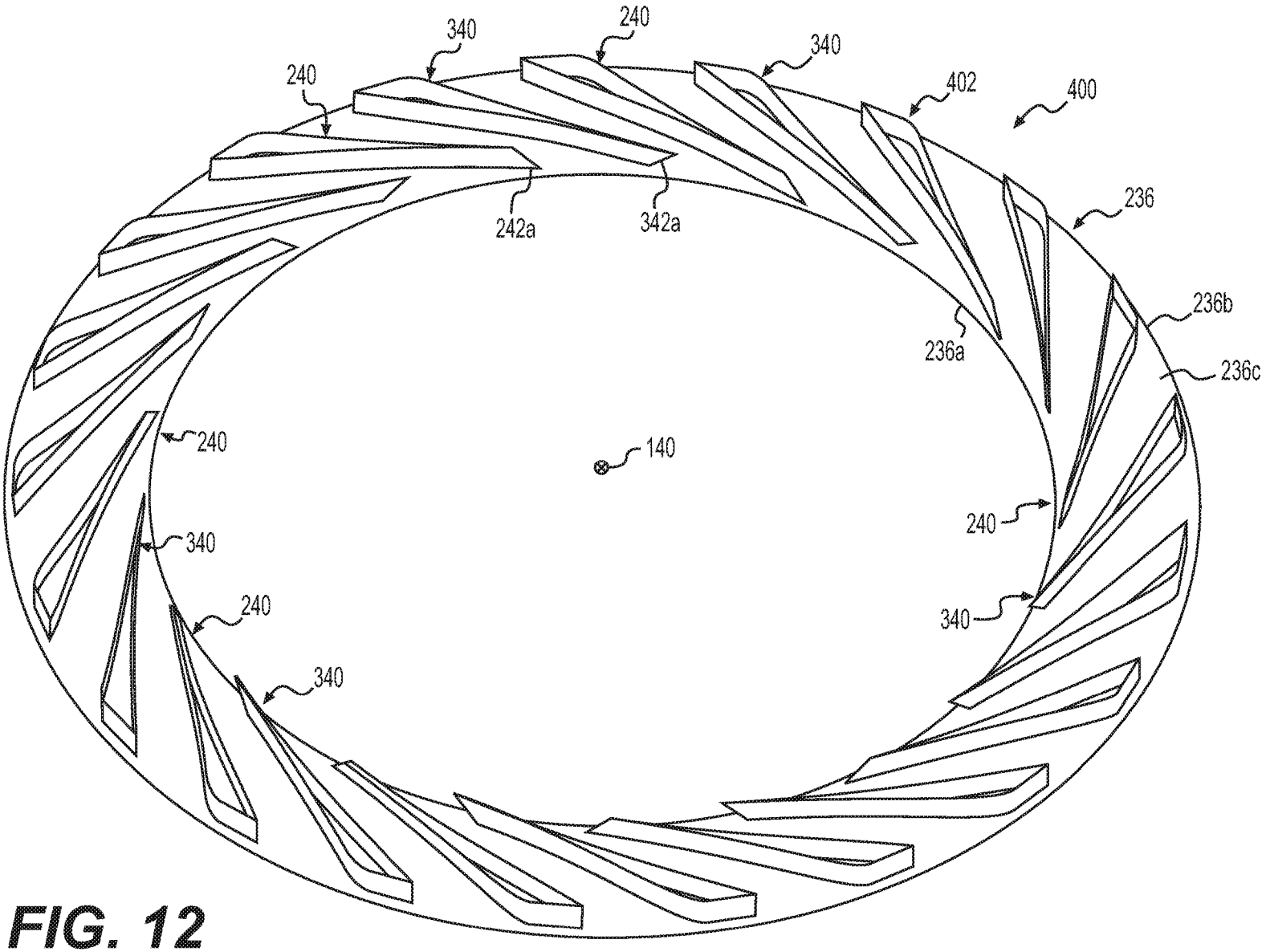
FIG. 12 is a front perspective view of a hub and a plurality of diffuser blades for an exemplary diffuser for use with the radial compressor of FIG. 2, in which a shroud of the diffuser is removed for clarity.

It should be noted that in other embodiments, a diffuser may be configured differently to improve efficiency of the radial compressor 200. For example, with reference to FIG. 12, a diffuser 400 is shown with a shroud associated the diffuser 400 removed for clarity. As the diffuser 400 includes components that are the same or similar to components of the diffuser 204 discussed with regard to FIGS. 1-9 and the diffuser 304 discussed with regard to FIGS. 10-11, the same reference numerals will be used to denote the same or similar components. Although not shown herein, the shroud of the diffuser 400 is substantially similar to the shroud 238 of the diffuser 204.

The diffuser 400 is downstream from the impeller 202, and is spaced apart from the impeller 202 by a vaneless gap. The diffuser 400 has the inlet 230 (not shown) in fluid communication with the impeller outlet 209 (not shown), and the outlet 232 (not shown) downstream from the inlet 230. The diffuser 400 includes the hub 436, a shroud (not shown) and at least one or a plurality of diffuser blades 402, which in this example, include a sub-plurality of the diffuser blades 240 and a sub-plurality of the diffuser blades 340. In one example, the diffuser blades 240, 340 are arranged in an alternating pattern about the hub 236; however, the diffuser blades 240, 340 may be arranged in any suitable pattern about the circumference of the hub 236. As the assembly and the use of the diffuser 400 is substantially the same as that discussed with regard to the diffuser 204 of FIGS. 1-9 and the diffuser 304 of FIGS. 10-11, the assembly and use of the diffuser 400 will not be discussed in great detail herein. Briefly, the diffuser 400 is formed such that the diffuser blades 402 are coupled between the hub 236 and the shroud, with the diffuser blades 240 alternating with the diffuser blades 340 about the circumference of the hub 236. Each of the diffuser blades 240 is formed with the cutback region 254, and each of the diffuser blades 340 is formed with the cutback region 354 formed from the leading edge 342 towards the trailing edge 246 in the radial direction. The diffuser 400 is coupled to the gas turbine engine 100 such that the impeller 202 is circumscribed by the diffuser 400 and the vaneless gap is defined between the leading edge line 242*a*, 342*a* and the impeller trailing edge 218 (not shown). The vaneless gap varies about the circumference of the diffuser 400. The diffuser 400, with the alternating diffuser blades 240, 340, results in a elliptically varied vaneless gap between the impeller trailing edge and the leading edge 242*a*, 342*a* along the span S. This elliptical profile mitigates flow losses arising from impeller vortices and may result in lower diffusion losses, which provides improved performance for the radial compressor 200.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A compressor of a gas turbine engine, comprising:

an impeller having a plurality of identical impeller blades, each impeller blade of the plurality of impeller blades having an impeller leading edge and an opposite impeller trailing edge, the impeller trailing edge upstream from an outlet of the impeller such that each of the plurality of impeller blades is spaced apart from the outlet of the impeller;

a diffuser downstream from the outlet of the impeller and having a diffuser inlet, a diffuser outlet downstream of the diffuser inlet and a plurality of diffuser blades coupled to the diffuser so as to be spaced apart from the diffuser inlet and the diffuser outlet, each diffuser blade having a leading edge and an opposite trailing edge, each diffuser blade extending from a hub to a shroud in a spanwise direction, the leading edge of each diffuser blade of the plurality of diffuser blades having a leading edge line that is straight, the leading edge of each diffuser blade spaced apart from the diffuser inlet and the impeller trailing edge of each of the plurality of impeller blades by a vaneless gap, each diffuser blade including a cutback region that extends from proximate the leading edge toward the trailing edge, the cutback region reduces a thickness of each of the plurality of diffuser blades such that a throat area defined between adjacent diffuser blades of the plurality of diffuser blades increases in the spanwise direction from the hub to the shroud; and the vaneless gap that is devoid of the plurality of impeller blades of the impeller and the plurality of diffuser blades of the diffuser, the vaneless gap having a first distance defined between the impeller trailing edge of each of the plurality of impeller blades and the leading edge of each of the plurality of diffuser blades at the hub of the diffuser and a second distance defined between the impeller trailing edge of each of the plurality of impeller blades and the leading edge of each of the plurality of diffuser blades at the shroud of the diffuser, and the second distance is different than the first distance such that the vaneless gap increases in the spanwise direction from the hub to the shroud.

2. The compressor of claim 1, wherein the vaneless gap increases monotonically in the spanwise direction.

3. The compressor of claim 1, wherein the cutback region extends from the hub to the shroud such that the thickness of each diffuser blade of the plurality of diffuser blades is reduced in the spanwise direction.

4. The compressor of claim 1, wherein for each diffuser blade of the plurality of diffuser blades, the cutback region is defined to extend from proximate the leading edge to a location downstream of the leading edge and upstream of the trailing edge and a thickness of each diffuser blade of the plurality of diffuser blades at the shroud is less than a thickness of each diffuser blade of the plurality of diffuser blades at the hub within the cutback region, and the thickness of each diffuser blade of the plurality of diffuser blades is unchanged from the location to the trailing edge.

5. The compressor of claim 4, wherein the cutback region extends from proximate the leading edge to the location that is about 5% downstream from the leading edge in a streamwise direction at the shroud of each diffuser blade of the plurality of diffuser blades.

6. The compressor of claim 1, wherein a chord length of each diffuser blade of the plurality of diffuser blades at the hub is greater than a chord length of each diffuser blade of the plurality of diffuser blades at the shroud.

7. The compressor of claim 1, wherein a throat defined between the adjacent diffuser blades of the plurality of diffuser blades increases from the leading edge to the trailing edge and a cross-sectional area of the diffuser increases linearly from the hub to the shroud.

8. The compressor of claim 1, wherein the leading edge line extends along an axis that is transverse to a second axis that extends along the impeller trailing edge of each impeller blade of the plurality of impeller blades and the leading edge line extends at an angle of 45 degrees relative to the hub.

9. The compressor of claim 8, wherein the axis of the leading edge line of each of the plurality of diffuser blades is transverse to a longitudinal axis of the gas turbine engine.

10. The compressor of claim 1, wherein the first distance is less than the second distance.

11. A compressor of a gas turbine engine, comprising:

an impeller having a plurality of impeller blades, each impeller blade of the plurality of impeller blades having an impeller leading edge and an opposite impeller trailing edge that extends along an axis, the impeller trailing edge upstream from an outlet of the impeller such that each of the plurality of impeller blades is spaced apart from the outlet of the impeller;

a diffuser downstream from the outlet of the impeller and having a diffuser inlet, a diffuser outlet downstream from the diffuser inlet and a plurality of diffuser blades coupled to the diffuser so as to be spaced apart from the diffuser inlet and the diffuser outlet, each diffuser blade having a leading edge and an opposite trailing edge, each diffuser blade extending from a hub to a shroud in a spanwise direction, the leading edge of each diffuser blade of the plurality of diffuser blades spaced apart from the diffuser inlet and the impeller trailing edge of each of the plurality of impeller blades by a vaneless gap, the leading edge of each of the plurality of diffuser blades having a leading edge line that is straight and extends along a second axis that is transverse to the axis of the impeller trailing edge of the respective one of the plurality of impeller blades, each diffuser blade including a cutback region that extends from proximate the leading edge toward the trailing edge, the cutback region reduces a thickness of each of the plurality of diffuser blades from the hub to the shroud or from the shroud to the hub such that a throat area defined between adjacent diffuser blades of the plurality of diffuser blades varies in the spanwise direction from the hub to the shroud;

the vaneless gap that is devoid of the plurality of impeller blades of the impeller and the plurality of diffuser blades of the diffuser, the vaneless gap having a first distance defined between the impeller trailing edge of each of the plurality of impeller blades and the leading edge of each of the plurality of diffuser blades at the hub of the diffuser and a second distance defined between the impeller trailing edge of each of the plurality of impeller blades and the leading edge of each of the plurality of diffuser blades at the shroud of the diffuser, and the second distance is different than the first distance such that the vaneless gap varies radially in the spanwise direction from the hub to the shroud; and a deswirl section downstream of the diffuser outlet.

12. The compressor of claim 11, wherein the vaneless gap increases monotonically in the spanwise direction.

13. The compressor of claim 11, wherein the vaneless gap decreases monotonically in the spanwise direction.

14. The compressor of claim 11, wherein the cutback region extends from the hub to the shroud such that the thickness of each diffuser blade of the plurality of diffuser blades is reduced in the spanwise direction.

15. The compressor of claim 11, wherein for each diffuser blade of the plurality of diffuser blades, the cutback region is defined to extend from proximate the leading edge to a location downstream of the leading edge and upstream of the trailing edge, and the thickness of each diffuser blade of the plurality of diffuser blades is unchanged from the location to the trailing edge.

16. The compressor of claim 11, wherein the plurality of diffuser blades includes a first sub-plurality of diffuser blades having the cutback region that reduces a thickness of each of the first sub-plurality of diffuser blades at the shroud such that the thickness of each of the first sub-plurality of diffuser blades at the shroud is less than a thickness of each of the first sub-plurality of diffuser blades at the hub, and a second sub-plurality of diffuser blades having the cutback region that reduces a thickness of each of the second sub-plurality of diffuser blades at the hub such that the thickness of each of the second sub-plurality of diffuser blades at the hub is less than a thickness of each of the second sub-plurality of diffuser blades at the shroud.

17. The compressor of claim 11, wherein a chord length of each diffuser blade of the plurality of diffuser blades at the hub is different than a chord length of each diffuser blade of the plurality of diffuser blades at the shroud.

18. The compressor of claim 11, wherein the throat area defined between adjacent diffuser blades of the plurality of diffuser blades increases in the spanwise direction from the hub to the shroud within the cutback region and a cross-sectional area of the diffuser increases linearly from the hub to the shroud.

19. A gas turbine engine, comprising:

a radial compressor including:

an impeller having an impeller shroud, an impeller hub and a plurality of impeller blades coupled to the impeller hub, the impeller shroud spaced apart from the plurality of impeller blades by a tip gap, each impeller blade of the plurality of impeller blades having an impeller leading edge and an opposite impeller trailing edge that extends along an axis, the impeller trailing edge upstream from an outlet of the impeller such that each of the plurality of impeller blades is spaced apart from the outlet of the impeller;

a diffuser downstream from the outlet of the impeller and having a diffuser inlet, a diffuser outlet downstream from the diffuser inlet and a plurality of identical diffuser blades spaced apart about a surface of a hub so as to be spaced apart from the diffuser inlet and the diffuser outlet, each diffuser blade having a leading edge and an opposite trailing edge, each diffuser blade extending from the hub to a shroud in a spanwise direction, the leading edge of each diffuser blade of the plurality of diffuser blades spaced apart from the diffuser inlet and the impeller trailing edge of each of the plurality of impeller blades by a vaneless gap, the leading edge of each of the plurality of diffuser blades having a leading edge line that extends along a second axis that is transverse to the axis of the impeller trailing edge of the respective one of the plurality of impeller blades, the leading edge line is straight and extends at an angle of 45 degrees relative to the hub, each diffuser blade including a cutback region that extends from 0% in a streamwise direction at a shroud side surface of the diffuser blade to 5% in the streamwise direction of the shroud side surface toward the trailing edge, and from the hub to the shroud, with the streamwise direction 0% at the leading edge and 100% at the trailing edge, the cutback region reduces a thickness of each of the plurality of diffuser blades in the spanwise direction such that a throat area defined between adjacent diffuser blades of the plurality of diffuser blades increases in the spanwise direction from the hub to the shroud;

the vaneless gap defined within the impeller and the diffuser that is devoid of the plurality of impeller blades of the impeller and the plurality of diffuser blades of the diffuser, the vaneless gap having a first distance defined between the impeller trailing edge of each of the plurality of impeller blades and the leading edge of each of the plurality of diffuser blades at the hub of the diffuser and a second distance defined between the impeller trailing edge of each of the plurality of impeller blades and the leading edge of each of the plurality of diffuser blades at the shroud of the diffuser, the second distance is greater than the first distance such that the vaneless gap increases radially in the spanwise direction from the hub to the shroud and a cross-sectional area of the diffuser increases linearly from the hub to the shroud; and a deswirl section downstream of the diffuser outlet.

20. The gas turbine engine of claim 19, wherein for each diffuser blade of the plurality of diffuser blades, the cutback region is defined to extend from proximate the leading edge to a location downstream of the leading edge and upstream of the trailing edge and a thickness of each diffuser blade of the plurality of diffuser blades at the shroud is less than a thickness of each diffuser blade of the plurality of diffuser blades at the hub within the cutback region, and the thickness of each diffuser blade of the plurality of diffuser blades is unchanged from the location to the trailing edge, and the axis of the leading edge line of each of the plurality of diffuser blades is transverse to a longitudinal axis of the gas turbine engine.

* * * * *